US006564538B2

(12) United States Patent
Deno et al.

(10) Patent No.: US 6,564,538 B2
(45) Date of Patent: May 20, 2003

(54) SPINNING APPARATUS AND METHOD AND HOLLOW GUIDE SHAFT MEMBER FOR SPINNING

(75) Inventors: Koji Deno, Oumihachiman (JP); Hisakatu Imamura, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 98 days.

(21) Appl. No.: 09/824,009

(22) Filed: Apr. 3, 2001

(65) Prior Publication Data

US 2001/0025474 A1 Oct. 4, 2001

(30) Foreign Application Priority Data

| | | |
|---|---|---|
| Apr. 4, 2000 | (JP) | 2000-106701 |
| Apr. 10, 2000 | (JP) | 2000-113226 |
| Nov. 13, 2000 | (JP) | 2000-344589 |

(51) Int. Cl.[7] ..... D01H 07/88
(52) U.S. Cl. ..... 57/328
(58) Field of Search ..... 57/328, 332, 333, 57/350

(56) References Cited

FOREIGN PATENT DOCUMENTS

| | | |
|---|---|---|
| JP | 4-118471 | 10/1992 |
| JP | 4118471 | * 10/1992 |

* cited by examiner

*Primary Examiner*—John J. Calvert
*Assistant Examiner*—Shaun R Hurley
(74) *Attorney, Agent, or Firm*—Armstrong, Westerman & Hattori, LLP

(57) ABSTRACT

The present invention provides a spinning apparatus comprising a spinning member U composed of a nozzle a nozzle member for generating a whirling current and a non-rotary hollow guide shaft member, wherein a yarn passing hole 7*b* near a tip portion 7*a* of a hollow guide shaft member 7 is formed to be non-circular.

The non-circular yarn passing hole near the tip portion of the hollow guide shaft member makes it possible to vary the whirling speed of reversed fibers whirled in a circumferential direction, thereby increasing the amount of hairinesses occurring in a spun-out yarn. Consequently, a soft spun yarn with many hairinesses can be manufactured without reducing the strength of the generated spun yarn.

16 Claims, 12 Drawing Sheets

SPINNING APPARATUS AND METHOD AND HOLLOW GUIDE SHAFT MEMBER FOR SPINNING

FIELD OF THE INVENTION

The present invention relates to a spinning apparatus for manufacturing a spun yarn by twisting fibers constituting a sliver leaving a draft device, using a spinning member composed of a nozzle member for generating a whirling current and a non-rotary hollow guide shaft member for spinning.

BACKGROUND OF THE INVENTION

Spinning devices are known which are composed of a nozzle member for generating a whirling current and a non-rotary hollow guide shaft member having a yarn passing hole and which spin a yarn while causing a whirling current generated by the nozzle member to act on a tip portion of the hollow guide shaft member. In such a spinning apparatus, reversed fibers occur at the tip portion of the hollow guide shaft member and are whirled there by means of the whirling current generated by the nozzle member. Then, the reversed fibers being whirled are wound around a fiber bundle drawn into the yarn passing hole in the hollow guide shaft member, thereby manufacturing a substantially twisted spun yarn.

However, an outer peripheral surface of the tip portion of the hollow guide shaft member and the yarn passing hole thereof are formed such that its cross section perpendicular to an axis of the hollow guide shaft member has a circular (round) cross section, so that the reversed fibers are whirled at substantially constant speed in a circumferential direction of the tip portion of the hollow guide shaft member. When the reversed fibers are thus whirled at the substantially constant speed in the circumferential direction, the reversed fibers are prevented from being disturbed to reduce the amount of hairiness occurring in a spun-out yarn, the surface of which thus feels hard.

It is contemplated that the pressure of compressed air injected from the nozzle member may be reduced to lower the effects of the whirling current on a rear end portion of the reversed fibers to thereby restrain the rear end portion of the reversed fibers from leaving an outer peripheral surface of the tip portion of the hollow guide shaft member, thus increasing the amount of hairiness occurring in the spun-out yarn. When, however, the pressure of the compressed air from the nozzle member is reduced, the strength of the generated spun yarn decreases to increase the yarn breakage rate, thereby reducing spinning efficiency.

The present invention is provided in view of the above problems, and it is an object thereof to solve these problems with the above-mentioned spinning apparatus to generate a spun yarn, the surface of which feels soft without reducing the yarn strength.

SUMMARY OF THE INVENTION

To attain this object, the present invention first provides a spinning apparatus comprising a nozzle member for generating a whirling current and a non-rotary hollow guide shaft member having a yarn passing hole so as to execute spinning while causing the whirling current generated by the nozzle member to act on a tip portion of the hollow guide shaft member, wherein a yarn passing hole at the tip portion of the hollow guide shaft member is formed to have a non-circular cross section. This makes it possible to vary a whirling speed of reversed fibers in a circumferential direction. Accordingly, the amount of hairiness occurring in a spun-out yarn increases to enable manufacturing of a soft spun yarn with much hairiness without reducing the strength of the generated spun yarn. Further, this configuration does not require a nozzle pressure (injection pressure) of the nozzle member to be changed, thereby making it possible to maintain an optimal flow rate for spinning. This serves to solve the problem that physical property values of yarns vary depending on the yarn count or the like.

Second, the yarn passing hole at the tip portion of the hollow guide shaft member has a laterally elongate or an elliptic cross section. This makes it possible to smoothly vary the whirling speed of the reversed fibers in the circumferential direction to prevent yarn breakage or the like.

Third, a maximum length of the yarn passing hole formed into a non-circular shape which length starts from the a yarn passing hole inlet located in a tip surface of the hollow guide shaft member equals an average fiber length of fibers constituting a fiber bundle. That is, the yarn passing hole has a non-circular shape over a predetermined length from the yarn passing hole inlet located at the tip surface of the hollow guide shaft member, and this noncircular portion is followed by a circular (round) portion at a downstream side.

The length of the non-circular portion of the yarn passing hole is equal to or smaller than the average fiber length of the fibers constituting the fiber bundle. Consequently, only a portion of the yarn passing hole which is involved in the whirling of the reversed fibers has a non-circular cross section, while a portion that is not involved in the whirling of the reversed fibers has a circular cross section. Therefore, a smooth air current can be maintained through the yarn passing hole in the hollow guide shaft member, thus preventing degradation of the quality of the generated spun yarn.

Fourth, the present invention provides a spinning apparatus comprising a nozzle member for generating a whirling current and a non-rotary hollow guide shaft member having a yarn passing hole so as to execute spinning while whirling reversed fibers at a tip portion of the hollow guide shaft member by means of the whirling current generated by the nozzle member, wherein a restraining section for partly varying a whirling speed of the reversed fibers in a circumferential direction is provided on an outer peripheral surface of the tip portion of the hollow guide shaft member which surface contacts with the reversed fibers. This makes it possible to vary the whirling speed of the reversed fibers in the circumferential direction. Accordingly, the amount of hairiness occurring in a spun-out yarn increases, while wound fibers are restrained from being tightened against the spun yarn, without reducing the strength of the generated spun yarn, thereby enabling manufacturing of a soft spun yarn with much hairiness. Furthermore, a cloth product woven of such spun yarns has a softer feel, and the rotation torque of the yarn decreases, thus allowing the yarn to be more appropriately released and colored during subsequent processes.

Fifth, flat surfaces as the restraining section are formed on the outer peripheral surface of the tip portion of the hollow guide shaft member. This makes it possible to effectively vary the whirling speed of the reversed fibers in the circumferential direction.

Sixth, the flat surfaces as the restraining section are formed at generally equal intervals in the circumferential direction. This makes it possible to effectively vary the whirling speed of the reversed fibers in the circumferential direction.

Seventh, projecting portions or groove portions as the restraining section are formed on the outer peripheral surface of the tip portion of the hollow guide shaft member. This makes it possible to effectively vary the whirling speed of the reversed fibers in the circumferential direction.

Eighth, the present invention provided a spinning apparatus comprising a nozzle member for generating a whirling current and a non-rotary hollow guide shaft member having a yarn passing hole so as to execute spinning while whirling reversed fibers at a tip portion of the hollow guide shaft member by means of the whirling current generated by the nozzle member, wherein an area at the tip portion of the hollow guide shaft member, which an outer peripheral surface shape of area contacts with the reversed fibers, is formed such that its cross section perpendicular to an axis of the hollow guide shaft member is not circular. This makes it possible to vary the whirling speed of the reversed fibers in the circumferential direction. Accordingly, the amount of hairiness occurring in a spun-out yarn increases, while wound fibers are restrained from being tightened against the spun yarn, without reducing the strength of the generated spun yarn, thereby enabling manufacturing of a soft spun yarn with much hairiness. Furthermore, a cloth product woven of such spun yarns has a softer feel, and the rotation torque of the yarn decreases, thus allowing the yarn to be more appropriately released and colored during subsequent processes.

Ninth, the present invention provides a spinning method for executing spinning while whirling reversed fibers at a tip portion of a non-rotary hollow guide shaft member by means of a whirling current acting on the tip portion of the hollow guide shaft member, wherein a whirling speed of the reversed fibers at the tip portion of the hollow guide shaft member is positively varied in a circumferential direction. This increases the amount of hairiness occurring in a spun-out yarn, while restraining tightening of wound fibers against a spun yarn, without reducing the strength of the generated spun yarn, thereby enabling manufacturing of a soft spun yarn with much hairiness. Furthermore, a cloth product woven of such spun yarns has a softer feel, and the rotation torque of the yarn decreases, thus allowing the yarn to be more appropriately released and colored during subsequent processes.

Tenth, the whirling speed is varied by partly restraining whirling of the reversed fibers at the tip portion of the hollow guide shaft member, in the circumferential direction. This makes it possible to effectively vary the whirling speed of the reversed fibers in the circumferential direction.

DETAILED DESCRIPTION OF THE PREFERRED EMBODIMENTS

Embodiments of the present invention will be described below with reference to FIGS. 1 to 15, but the present invention is not limited to the following embodiments unless the spirit of the invention is deviated therefrom.

Figure 12:
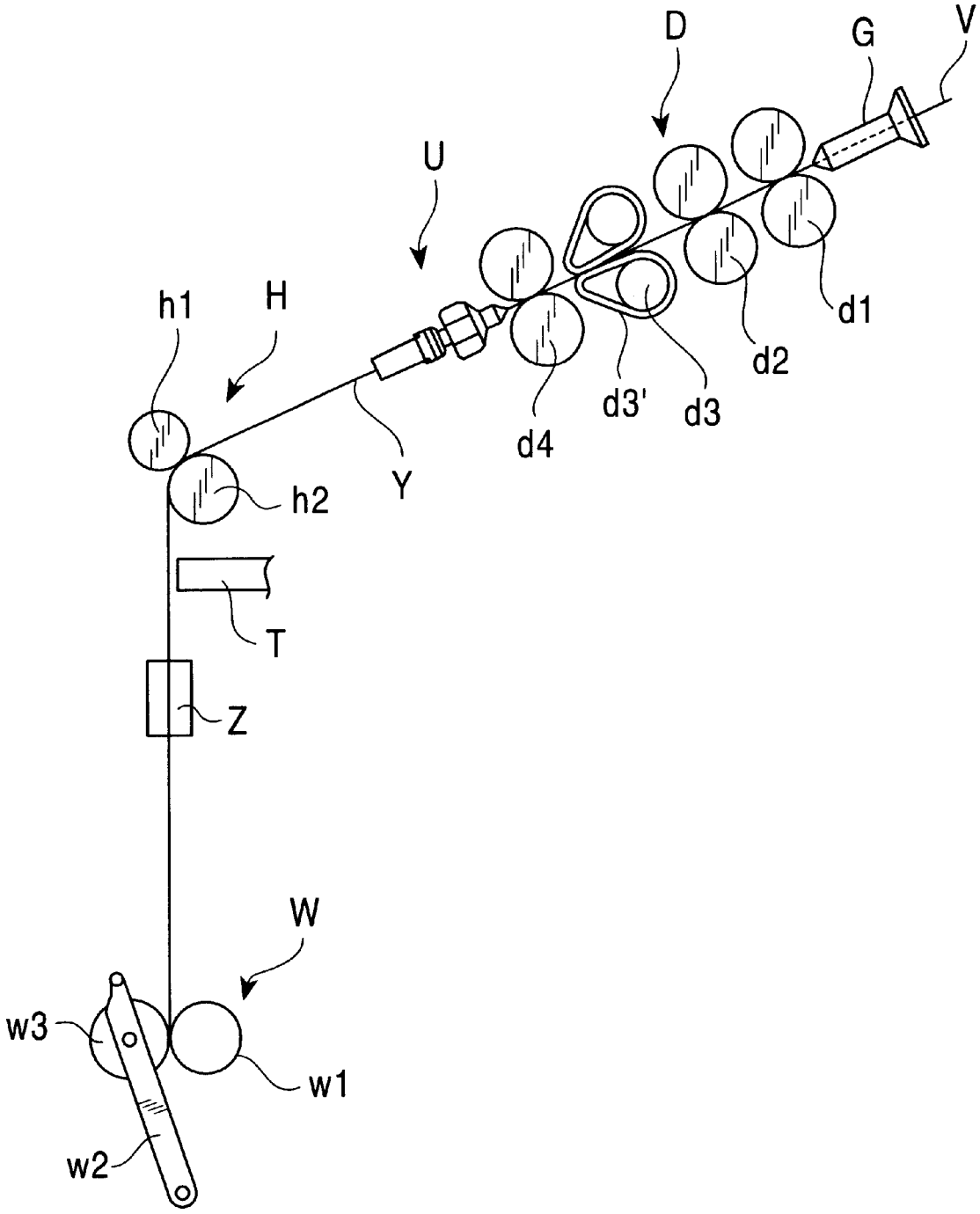
FIG. 12 is a schematic side view of a spinning unit constituting the spinning apparatus.

First, the entire configuration of a spinning apparatus will be explained with reference to FIG. 12. In this figure, V is a sliver supplied to a draft device D via a sliver guide G. The draft device D comprises, for example, a back roller d1, a third roller d2, a second roller d3, with an apron d3', and a front roller d4. The sliver V drafted by the draft device D is supplied to a spinning member U, described later, which forms the sliver V into a spun yarn Y. The spun yarn Y then is passed through a spun yarn feeding device H composed of a nip roller h1 and a delivery roller h2 and through a slack tube T configured as a suction tube, a yarn clearer Z, and the like, and is wound into a package w3 driven by a friction roller w1 and supported by a cradle arm w2 of a winding section W. The spinning apparatus comprises a large number of spinning units arranged in a line of a base and each composed of the draft device D, the spinning member U, the spun yarn feeding device H, the slack tube T, the yarn clearer Z, the winding section W, and the like.

Figure 13:
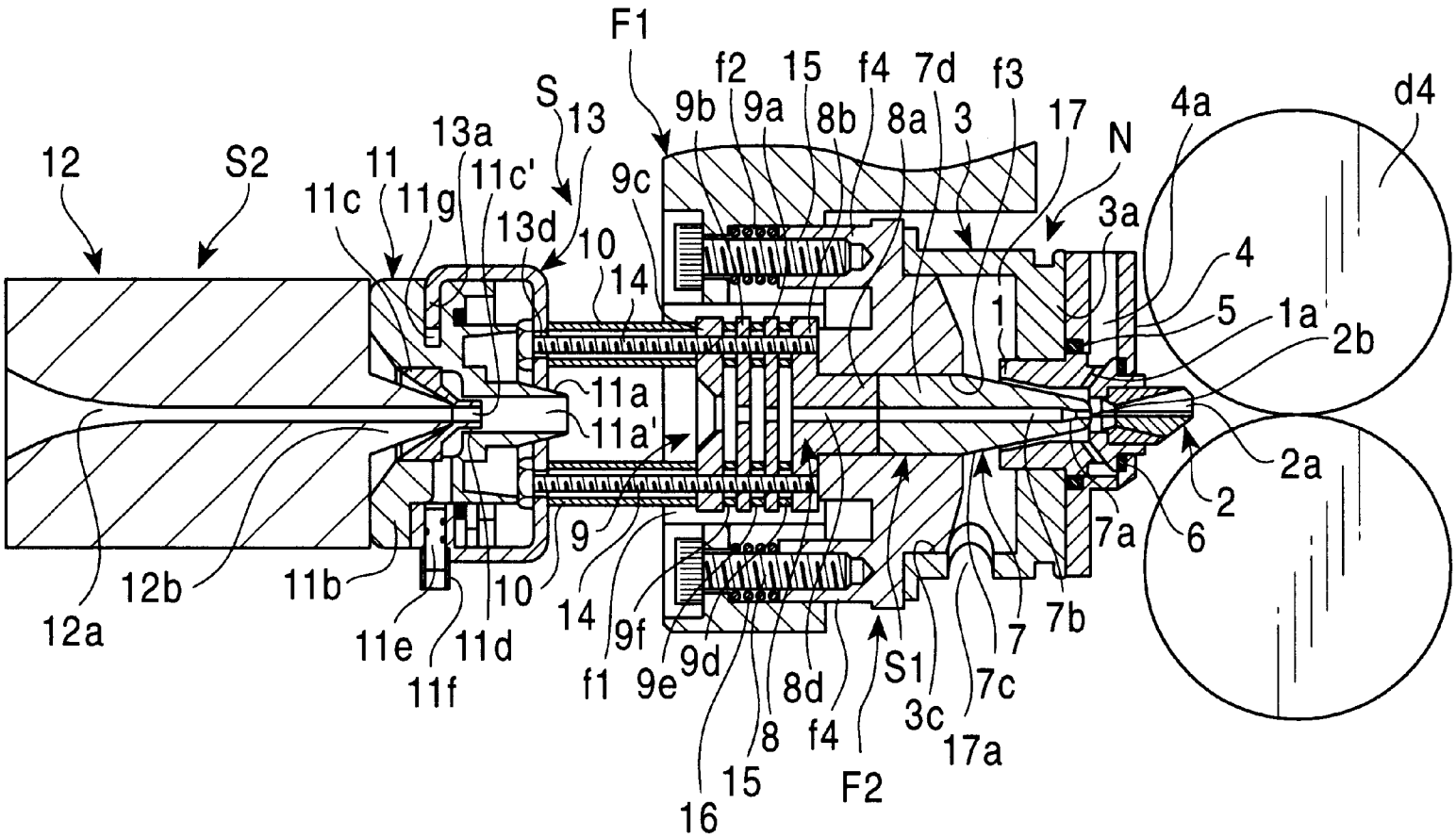
FIG. 13 is a vertical sectional view of a spinning member and the like of the spinning apparatus.
Figure 14:
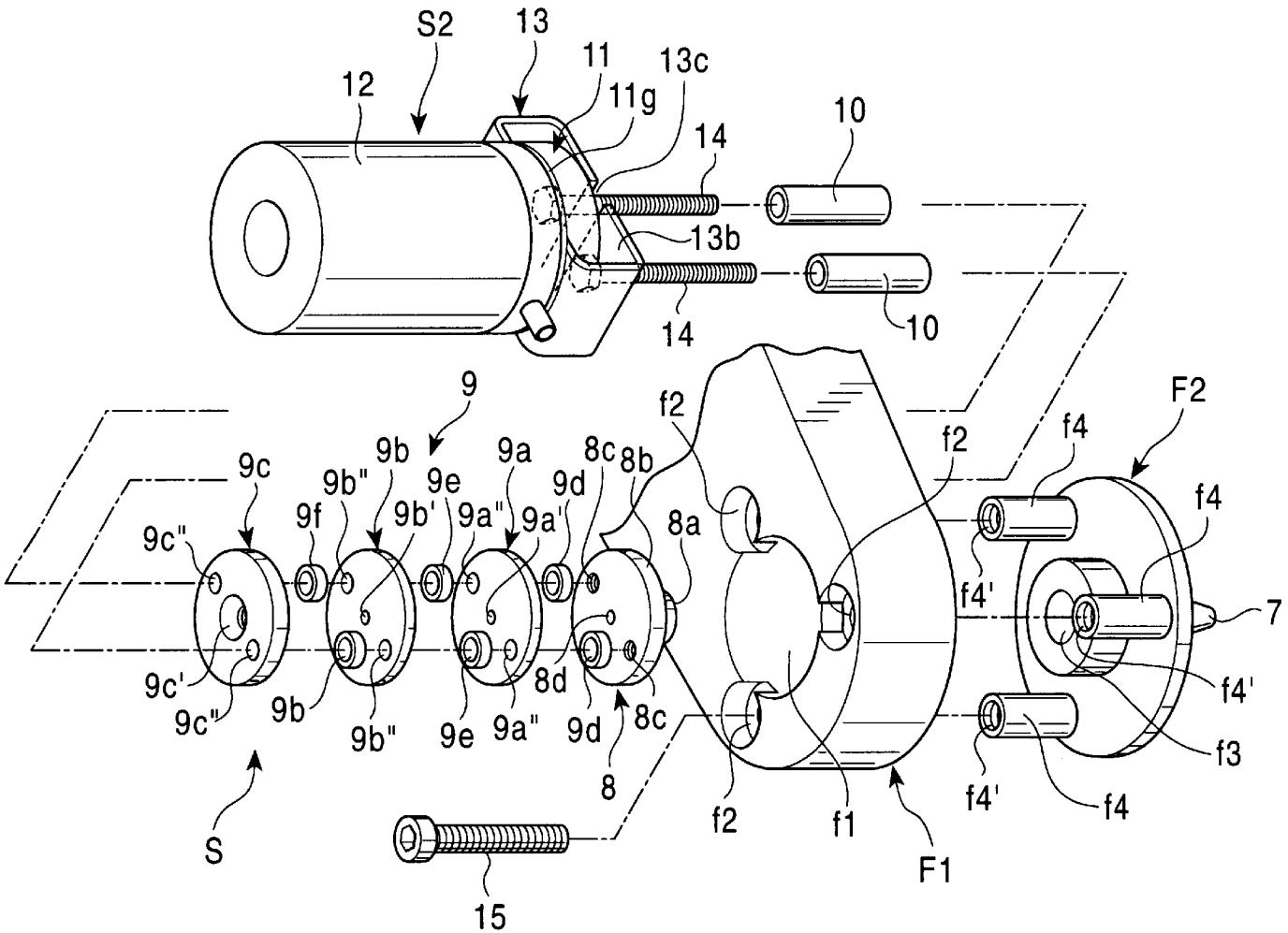
FIG. 14 is an exploded perspective view of a hollow guide shaft member and the like constituting the spinning apparatus.
Figure 15:
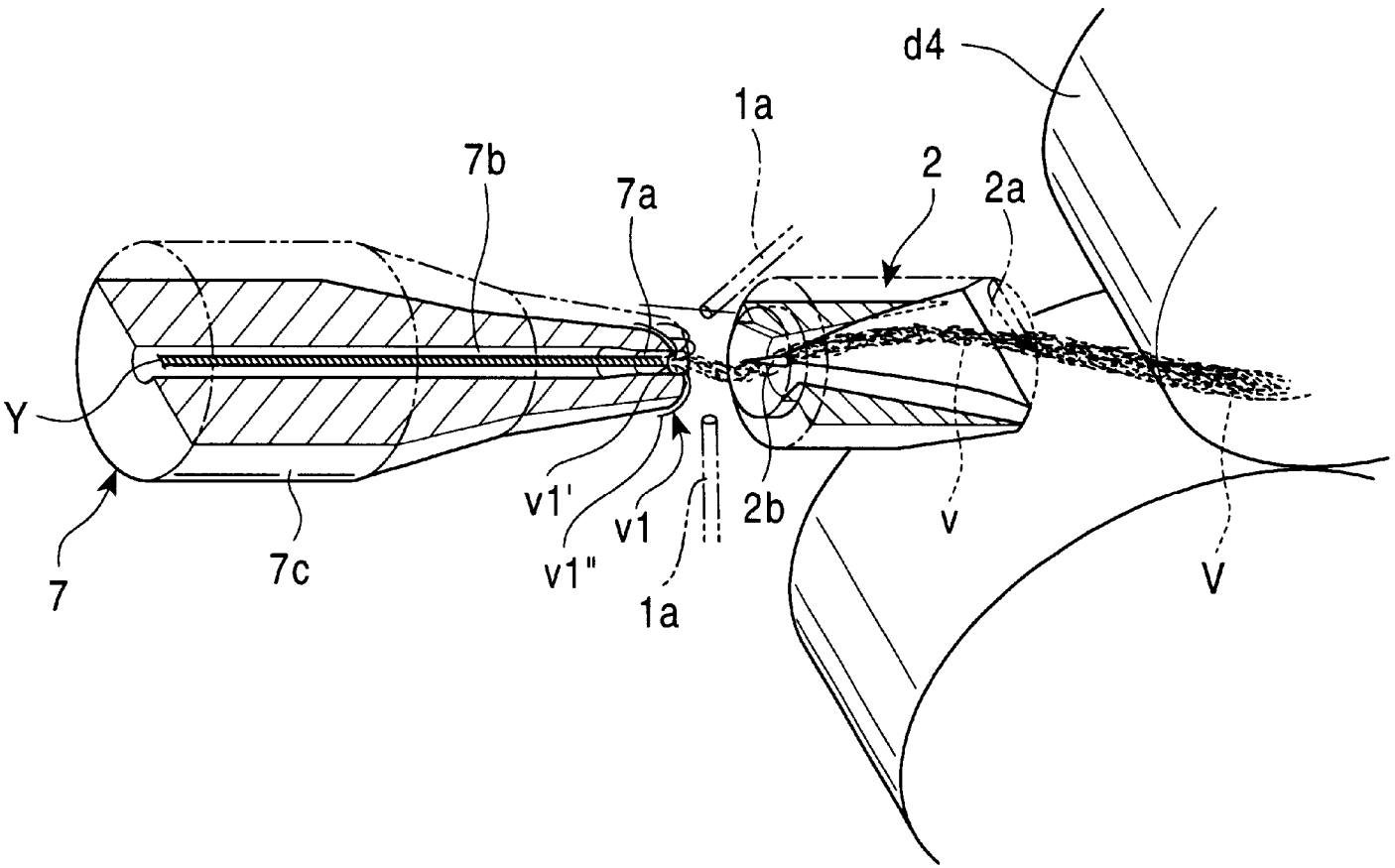
FIG. 15 is a schematic perspective view of the first hollow guide shaft and the like, which is useful in explaining a process of generating a spun yarn.

Next, the spinning member U used in the above-mentioned spinning apparatus will be described with reference to FIGS. 13 and 14.

N is a nozzle member, and S is a non-rotary hollow guide shaft member supported by a hollow guide shaft supporting frame F2, described later, the nozzle member N and the hollow guide shaft member S constitute the spinning member U.

Next, the nozzle member N constituting the spinning member U will be explained.

1 is a substantially cylindrical nozzle block having a plurality of air injecting holes 1*a* in an inner peripheral surface thereof in a tangential direction, and 2 is a fiber introducing block fitted on the front roller d4 side of the nozzle block 1 and having a fiber introducing hole 2*a* and a guide pin 2*b*. 3 is a nozzle housing mounted on an appropriate base frame of the spinning apparatus, the nozzle block 1 having the fiber introducing block 2 fitted in a tip portion thereof is inserted into a through-hole formed in a side wall 3*a* formed on a front roller d4 side of the nozzle housing 3. 4 is a compressed air supplying block attached to the nozzle block 1 so as to cover an air injecting hole 1*a* formed in the nozzle block 1, the compressed air supplying block 4 having a compressed air supplying hole 4*a* formed therein for supplying compressed air to the air injecting hole 1*a* formed in the nozzle block 1. 5 and 6 are packings disposed in annular space portions formed between the nozzle block 1 and the nozzle housing 3 and the compressed air supplying block 4 and between the nozzle block 1 and the compressed air supplying block 4.

Next, the hollow guide shaft member S constituting the spinning member U will be explained.

The hollow guide shaft member S comprises a front hollow guide shaft member portion S1 composed of a first hollow guide shaft 7 having a tapered tip portion 7*a* located in the nozzle block 1 and arranged close to the guide pin 2*a* of the fiber introducing block 2 and a second hollow guide shaft 8 composed of a cylindrical portion 8*a* abutting against an end surface of the hollow guide shaft 7 and a collar portion 8*b* formed at an end portion of the cylindrical portion 8*a*; a guide plate portion 9 arranged on the winding section W side of the second hollow guide shaft 8 constituting the front hollow guide shaft portion S1, the guide plate portion 9 being composed of a plurality of guide plates 9*a*, 9*b* and 9*c* disposed at predetermined intervals, and the guide plates 9*a*, 9*b* and 9*c* having yarn passing holes 9*a*', 9*b*' and 9*c*'.

In this embodiment, the guide plate portion 9 comprises three guide plates 9*a*, 9*b* and 9*c*, which are called the "first guide plate 9*a*", the "second guide plate 9*b*", and the "third guide plate 9*c*" for convenience; these guide plates 9*a*, 9*b* and 9*c* are numbered based on an order starting with the one closest to the second hollow guide shaft 8. As described above, the first guide plate 9*a*, the second guide plate 9*b*, and the third guide plate 9*c* have the yarn passing holes 9*a*', 9*b*' and 9*c*', respectively, formed therein, and each have a pair of bolt holes 9*a*", 9*b*" and 9*c*" formed symmetrically with respect to the yarn passing holes 9*a*', 9*b*' and 9*c*'.

A pair of pipe-shaped interval adjusting cylinders 9*d* are arranged between the second hollow guide shaft 8 and the first guide plate 9*a*, and a pair of pipe-shaped interval adjusting cylinders 9*e* are similarly arranged between the first guide plate 9*a* and the second guide plate 9*b*. Further, a pair of pipe-shaped interval adjusting cylinders 9*f* are arranged between the second guide plate 9*b* and the third guide plate 9*c*. Varying the length of the interval adjusting cylinders 9*d*, 9*e* and 9*f* makes it possible to properly adjust the interval between the second hollow guide shaft 8 and the first guide plate 9*a*, the interval between the first guide plate 9*a* and the second guide plate 9*b*, and the interval between the second guide plate 9*b* and the third guide plate 9*c*.

A rear hollow guide shaft portion S2 comprises a sucker 11 and a guide cylinder 12. The sucker 11 has a cylinder 11*b* having a first nozzle 11*a* extending toward the guide plate portion 9 and a second nozzle 11*c* fitted in the cylinder 11*b* and having its tip portion inserted into a yarn passing hole 11*a*' in the first nozzle 11*a*. An annular slit 11*d* is formed between an inner peripheral surface of the first nozzle 11*a* and an outer peripheral surface of the tip portion of the second nozzle 11*c* inserted into the yarn passing hole 11*a*" in the first nozzle 11*a*. The cylinder 11*b* has a compressed air supplying hole 11*e* formed therein, and a connection pipe 11*f* inserted into the compressed air supplying hole 11*e* is connected to a compressed air source via a pipe (not shown in the drawings). The guide cylinder 12 having a yarn passing clot 12*a* is attached to a winding section W-side end surface of the sucker 11 by means of appropriate fixtures such as screws and bolts (not shown in the drawings) directly or via appropriate connection members. Further, a winding section W-side end surface of the yarn passing hole 12*a* in the guide cylinder 12 is formed to gradually fan out to the outside to facilitate the insertion of a leading yarn (parent yarn) into the yarn passing hole 12*a* for a yarn splicing operation, and the guide cylinder 12 has a truncated cone portion 12*b* formed on a second nozzle 11*c*-side end surface and partly inserted into the yarn passing hole 11*c*" in the second nozzle 11*c*.

13 is a substantially C-shaped connection member configured so as to be attached to the cylinder 11*b* of the sucker 11 by fitting an end portion 13*a* thereof in a slit 11*g* formed in an outer peripheral surface of the cylinder 11*b* of the sucker 11. The sucker 13 has a slit 13 formed in a central portion 13*b* thereof and into which a tip portion of the first nozzle 11*a* of the above-mentioned sucker 11 is inserted.

Next, the assembly of the hollow guide shaft member S will be explained.

The interval adjusting cylinder 9*d* is arranged between the second hollow guide shaft 8 and the first guide plate 9*a*, and the interval adjusting cylinder 9*e* is arranged between the first guide plate 9*a* and the second guide plate 9*b*. Further, the interval adjusting cylinder 9*f* is arranged between the second guide plate 9*b* and the third guide plate 9*c*, and a pipe member 10 is arranged between the third guide plate 9*c* and the connection member 13. Then, bolts 14 are inserted into a pair of bolt holes 13*d* formed across the slit 13*c* in the central portion 13*b* of the connection member 13 and are passed through the pipe member 10, the bolt holes 9*c*" in the third guide plate 9*c*, the interval adjusting cylinder 9*f*, the bolt holes 9*b*" in the second guide plate 9*b*, the interval adjusting cylinder 9*e*, the bolt holes 9*a*" in the first guide plate 9*a*, and the interval adjusting cylinder 9*d* in this order. Subsequently, tip portions of the bolts 14 are screwed into bolt holes 8*c* formed in the collar potion 8*b* of the second hollow guide shaft 8 to thereby assemble the second hollow guide shaft 8, the guide plate portion 9, the pipe member 10 and the connection member 13 together. Then, the end portion 13*a* of the connection member 13 is fitted in the slit 11*g* formed in the outer peripheral surface of the cylinder 11*b* of the sucker 11 to attach the second hollow guide shaft 8, the guide plate portion 9, the pipe member 10 and the connection member 13 assembled as mentioned above, to the cylinder 11*b* of the sucker 11.

F1 is a support frame attached to the base and having a hole f1 formed therein and into which the hollow guide shaft member S can be inserted. Further, an appropriate number (in the embodiment, three) of bolt passing holes f2 are formed around the hole f1.

F2 is a generally disk-shaped hollow guide shaft supporting block having a through-hole f3 in the center and leg portions f4 formed correspondingly to the bolt passing holes f2 in the support frame F1, the leg portions f4 each having a screw hole f4'.

The first hollow guide shaft 7 of the hollow guide shaft S has its large diameter portion 7*d* fitted in the through-hole f3 substantially up to the middle thereof, the through-hole f3 being formed in the central portion of the hollow guide shaft supporting block F2, the large diameter portion 7*d* attached to the hollow guide shaft supporting block F2 by means of appropriate securing means such as bolts.

Moreover, once the second hollow guide shaft 8, the guide plate portion 9, the pipe member 10, the connection member 13, the sucker 11 and the guide cylinder 12 is assembled as mentioned above, the cylindrical portion 8*a* of the hollow guide shaft 8 is fitted in the through-hole f3 formed in the central portion of the hollow guide shaft supporting block F2 from the side of the leg portions f4 of the hollow guide shaft supporting block F2, and the second hollow guide shaft 8 is attached to the hollow guide shaft supporting block F2 by means of appropriate securing means such as bolts. In this manner, the second hollow guide shaft 8, the guide plate portion 9, the pipe member 10, the connection member 13, the sucker 11 and the guide cylinder 12 are attached to the hollow guide shaft supporting block F2.

Subsequently, the hollow guide shaft supporting block F2 with the hollow guide shaft member S attached thereto is attached to the support frame F1 by fitting the hollow guide shaft supporting block F2 in an opening 3*c* in the nozzle housing 3 in such a manner that an end surface of an end flange 3*b* of the nozzle housing 3 come into abutment with an end surface of the hollow guide shaft supporting block F2, inserting bolts 15 into the bolt passing holes f2 in the support frame F1, and screwing tip portions of the bolt passing holes f2, via coil springs 16, into the screw holes f4' formed in the leg portions f4 of the hollow guide shaft supporting block F2.

The hollow guide shaft member S attached to the support frame F1 via the hollow guide shaft supporting block F2 is configured so as to ensure alignment of the center lines of the yarn passing hole 7*b* in the first hollow guide shaft 7, the yarn passing hole 8*d* in the second hollow guide shaft 8, the yarn passing hole 9*a*' in the first guide plate 9*a*, the yarn passing hole 9*b*' in the second guide plate 9*b*, the yarn passing hole 9*c*' in the third guide plate 9*c*, the yarn passing hole 11*a*' in the first nozzle 11*a*, the yarn passing hole 11*c*' in the second nozzle 11*c*, and the yarn passing hole 12*a* in the guide cylinder 12. Thus, in the hollow guide shaft member S composed of the first hollow guide shaft 7, the second hollow guide shaft 8, the guide plate portion 9, the pipe member 10, the connection member 13, the sucker 11, the guide cylinder 12, and the like, the tapered tip portion 7*a* of the first hollow guide shaft 7 of the hollow guide shaft member S is located in the nozzle block 1 and close to the guide pin 2*b* of the fiber introducing block 2, and the nozzle member N and the hollow guide shaft member S constituting the spinning member U.

The following brief description focuses on a process of generating a yarn using a spinning unit having the spinning member U disposed therein and composed of the nozzle member N and the hollow guide shaft member S configured as described above by using mainly FIG. 15.

The drafted sliver V from the front roller d4 of the draft device D is fed along a periphery of the guide pin 2*b* and then sucked into the nozzle block 1, by means of a sucking air current generated near the fiber introducing hole 2*a* in the fiber introducing block 2 due to the action of air injected from the air injecting hole 1*a* in the nozzle block 1. Fibers v constituting the sliver V sucked into the nozzle block 1 undergo, near the tip portion 7*a* of the first hollow guide shaft 7, the action of a whirling current injected from the air injecting hole 1*a* and whirling near an outer periphery of the tip portion 7*a* of the first hollow guide shaft 7, so that the fibers v are twisted in the direction of the whirling current while being separated from the sliver V. Additionally, the fibers v constituting the sliver V sucked into the nozzle block 1 undergo, near the tip portion 7*a* of the first hollow guide shaft 7, the action of the whirling current injected from the air injecting hole 1*a* and whirling near the outer periphery of the tip portion 7*a* of the first hollow guide shaft 7, so that the fibers v are thus twisted and formed into a spun yarn, while passing through the yarn passing hole 7*b* in the first hollow guide shaft 7, the yarn passing hole 8*d* in the second hollow guide shaft 8, the yarn passing hole 9*a*' in the first guide plate 9*a*, the yarn passing hole 9*b* in the second guide plate 9*b*, the yarn passing hole 9*c*' in the third guide plate 9*c*, the yarn passing hole 11 a' in the first nozzle 11*a*, the yarn passing hole 11*c*' in the second nozzle 11*c*, and the yarn passing hole 12*a* in the guide cylinder 12. The yarn is then fed toward the winding section W by means of the spun yarn feeding device H composed of the nip roller h1 and the delivery roller h2.

When the fibers v constituting the sliver V are inserted into the yarn passing hole 7*b* in the first hollow guide shaft 7, a front end portion v1' of the fibers v enters the yarn passing hole 7*b* in the first hollow guide shaft 7, and a rear end portion v1" of the fibers is wound, by means of the above-mentioned whirling current, on an outer periphery of the tip portion 7*a* of the first hollow guide shaft 7 along an outer peripheral surface of the tip portion 7*a*, while being whirled along the tip portion 7*a* of the first hollow guide shaft 7 due to the action of the whirling current. In this manner, the fibers v1 wound and bent on the tip portion 7*a* of the first hollow guide shaft 7 in such a manner that the front end portion v1' thereof enters the yarn passing hole 7*b* in the first hollow guide shaft 7, while the rear end portion v1" thereof runs along the tip portion 7*a* of the first hollow guide shaft 7 (such fibers are hereafter referred to as "reversed fibers") are distributed substantially uniformly in a circumferential direction of the tip portion 7*a* of the first hollow guide shaft 7 and are entangled with and wound on the true twisted spun yarn twisted by means of the above-mentioned whirling current. A part of the twisting effected by the whirling current attempts to propagate toward the front roller d4, but the guide pin 2*b* of the fiber introducing block 2 hinders the propagation to prevent the sliver V delivered by the front roller d4 from being twisted into the yarn during false twisting.

17 is an air chamber formed between the nozzle housing 3 and the hollow guide shaft supporting block F2 and connected to an air suction source (not shown in the drawings) for sucking air with a low suction pressure so as to function, during spinning, as a runaway for air injected from the air injecting hole 1*a* in the nozzle block 1, while serving to suck and remove floating fibers or the like occurring in the air chamber 17 during spinning.

As described above, when the fibers v constituting the sliver V are inserted into the yarn passing hole 7*b* in the first hollow guide shaft 7, the front end portion v1' of the fibers v enters the yarn passing hole 7*b* in the first hollow guide shaft 7, and the rear end portion v1" of the fibers v is wound, by means of the whirling current, on the outer periphery of the tip portion 7*a* of the first hollow guide shaft 7 along an outer peripheral surface of the tip portion 7*a*, while being whirled along the tip portion 7*a* of the first hollow guide shaft 7 due to the action of the whirling current. Thus, the fibers v1 wound and bent on the tip portion 7*a* of the first hollow guide shaft 7 in such a manner that the front end portion v1' thereof enters the yarn passing hole 7*b* in the first hollow guide shaft 7, while the rear end portion v1" thereof runs along the tip portion 7*a* of the first hollow guide shaft 7 are distributed substantially uniformly in the circumferential direction of the tip portion 7*a* of the first hollow guide shaft 7 and are entangled with and wound on the true twisted spun yarn twisted by means of the whirling current.

Configurations relating to characteristic parts of the present invention will be described below with reference to FIGS. 1 to 11.

First, a characteristic configuration for achieving the object of the present invention will be explained with reference to FIGS. 1 to 6.

Results of studies conducted by the inventor indicate that when the reversed fibers v1 are whirled at a substantially constant speed in the circumferential direction of the tip portion 7*a* (the area in contact with the reversed fibers v1) of the first hollow guide shaft 7 due to the whirling current formed around the tip portion 7*a* of the first hollow guide shaft 7 by means of the air injected from the air injecting hole 1*a* in the nozzle block 1, the reversed fibers v1 are prevented from being disturbed to reduce the amount of hairiness in a spun-out yarn but that if the whirling force of the reversed fibers v1, which are being whirled in the circumferential direction, is restrained at the tip portion 7*a* of the first hollow guide shaft 7 to vary the speed of the reversed fibers v1 in the circumferential direction, then the rear end portion v1" of the reversed fibers v1 becomes likely to leave the outer peripheral surface of the tip potion 7*a* of the first hollow guide shaft 7 to increase the amount of hairiness occurring in the spun-out yarn. That is, the inventor has found that when the whirling speed of the reversed fibers v1 is positively varied in the circumferential direction, the amount of hairiness can be increased to manufacture a soft spun yarn.

Figure 1:
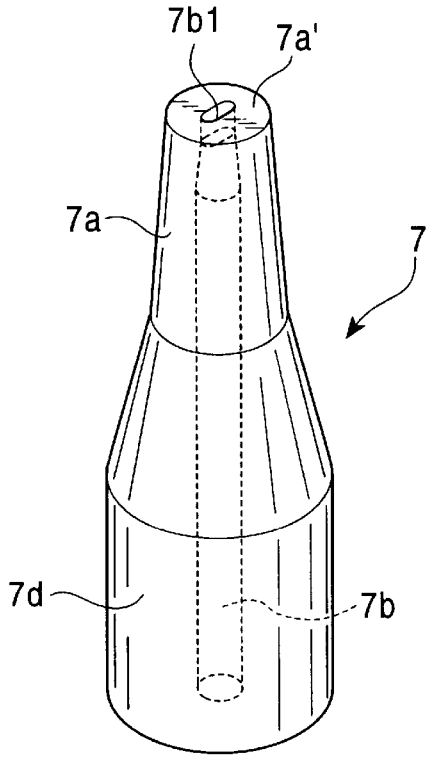
FIG. 1 is a perspective view of a first hollow guide shaft constituting a hollow guide shaft member of a spinning apparatus according to the present invention.
Figure 2:
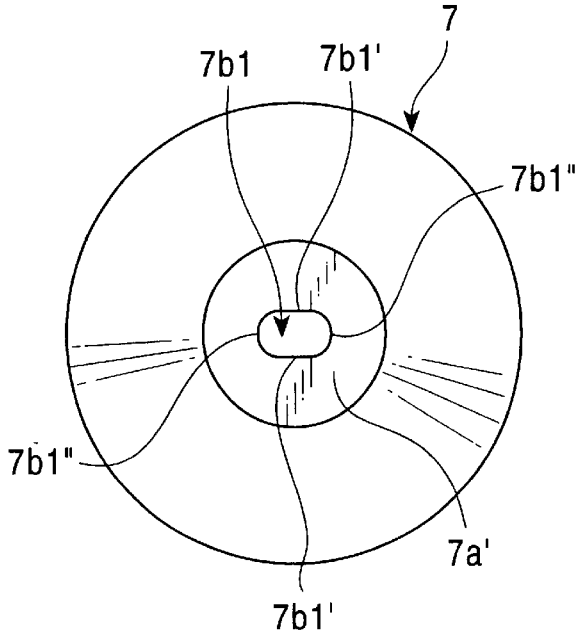
FIG. 2 is a top view of the first hollow guide shaft as seen from its top portion.

To vary the whirling speed of the reversed fibers v1, which are being whirled in the circumferential direction, the yarn passing hole 7*b* formed in the first hollow guide shaft 7 is formed into a laterally elongate hole 7*b*1 as seen from the tip portion 7*a* of the yarn passing hole 7*b* according to the embodiment shown in FIGS. 1 and 2. Although the yarn passing hole 7*b* may be formed into the laterally elongate hole 7*b*1 over its length, that is, the length of the first hollow guide shaft 7, if it is formed into the laterally elongate hole 7*b*1 extending from the tip surface 7*a*' of the tip portion 7*a* over the average fiber length of the fibers v constituting the sliver V, at maximum, then the whirling force of the reversed fibers v1, which are being whirled in the circumferential direction, can be restrained to sufficiently vary the whirling speed of the reversed fibers v1, as described above.

As described above, the neighborhood of the tip portion 7*a* of the yarn passing hole 7*b* formed in the first hollow guide shaft 7 is formed into the laterally elongate hole 7*b*1. Accordingly, on a longer side 7*b*1' of the laterally elongate hole 7*b*1, the reversed fibers v1, which are being whirled in the circumferential direction, are subjected to a lower resistance and thus whirled faster, and in transitional areas from the longer side 7*b*1' to a shorter side 7*b*1" and from the shorter side 7*b*1" to the longer side 7*b*1', they are subjected to a higher resistance and thus whirled slower. Thus, since the neighborhood of the tip portion 7*a* of the yarn passing hole 7*b* is formed into the laterally elongate hole 7*b*1, the whirling force of the reversed fibers v1, which are being whirled in the circumferential direction, can be restrained to vary the whirling speed of the reversed fibers v1. Consequently, the amount of hairiness occurring in the spun-out yarn can be increased to manufacture a soft spun yarn with much hairiness without reducing the strength of the generated spun yarn. The reason why the amount of hairiness can be increased without reducing the strength of the generated spun yarn is assumed to be that not all of the winding force of the wound fibers contributes to the strength of the yarn, so that those of the wound fibers which do not contribute to the strength can be formed into hairiness.

Figure 3:
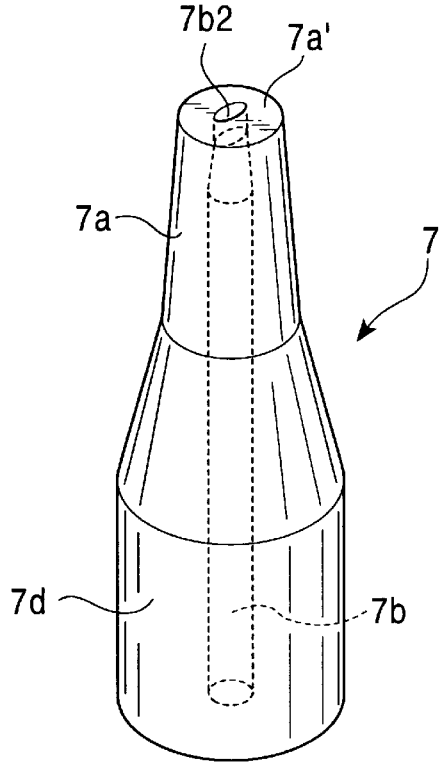
FIG. 3 is a perspective view of another embodiment of the first hollow guide shaft constituting the hollow guide shaft member of the spinning apparatus according to the present invention.
Figure 4:
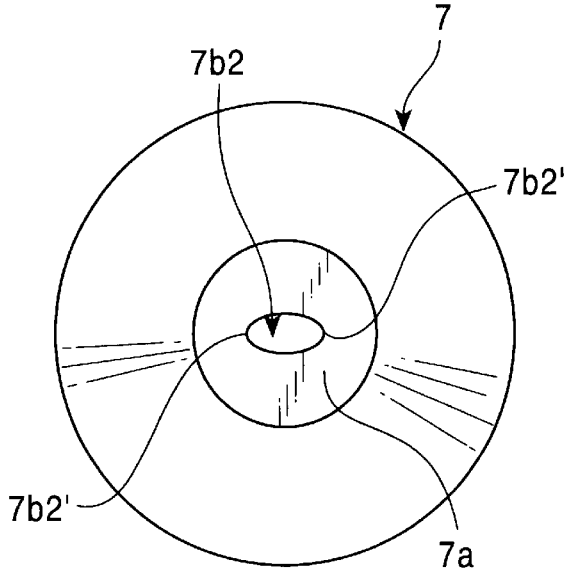
FIG. 4 is a top view of the first hollow guide shaft in FIG. 3 as seen from its top portion.

In the embodiment shown in FIGS. 3 and 4, the yarn passing hole 7*b* formed in the first hollow guide shaft 7 is formed into an elliptic hole 7*b*2 as seen from the tip portion 7*a* of the yarn passing hole 7*b*. In this case, the reversed fibers v1, which are being whirled in the circumferential direction, are subjected to a higher resistance and thus whirled slower when passing through opposite ends 7*b*2' of the elliptic hole 7*b*2 which have a larger diameter. As described above, although the yarn passing hole 7*b* may be formed into the elliptic hole 7*b*2 over its length, that is, the length of the first hollow guide shaft 7, if it is formed into the elliptic hole 7*b*2 extending from the tip surface 7*a*' of the tip portion 7*a* over the average fiber length of the fibers v constituting the sliver V, at maximum, then the whirling speed of the reversed fibers v1, which are being whirled in the circumferential direction, can be varied sufficiently, as described above.

It has been found that if the yarn passing hole 7*b* formed in the first hollow guide shaft 7 is formed in the laterally elongate hole 7*b*1 or the elliptic hole 7*b*2 as seen from the tip portion 7*a* of the yarn passing hole 7*b*, the hole having a larger and a smaller diameters which are orthogonal with each other, as described above, then the strength of the spun yarn depends on the size the smaller diameter. Accordingly, despite the increased cross section of the yarn passing hole 7*b*, a soft spun yarn can be generated without reducing the strength of the yarn, by setting the size of the smaller diameter substantially equal to that of the diameter of a circuit cross section.

Figure 5:
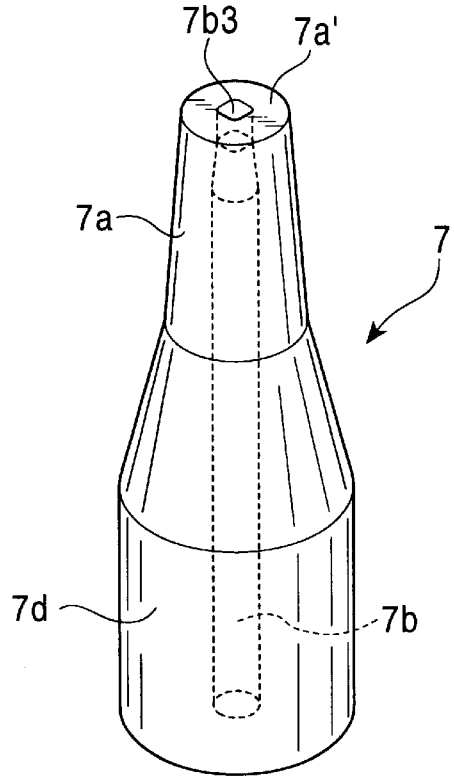
FIG. 5 is a perspective view of yet another embodiment of the first hollow guide shaft constituting the hollow guide shaft member of the spinning apparatus according to the present invention.
Figure 6:
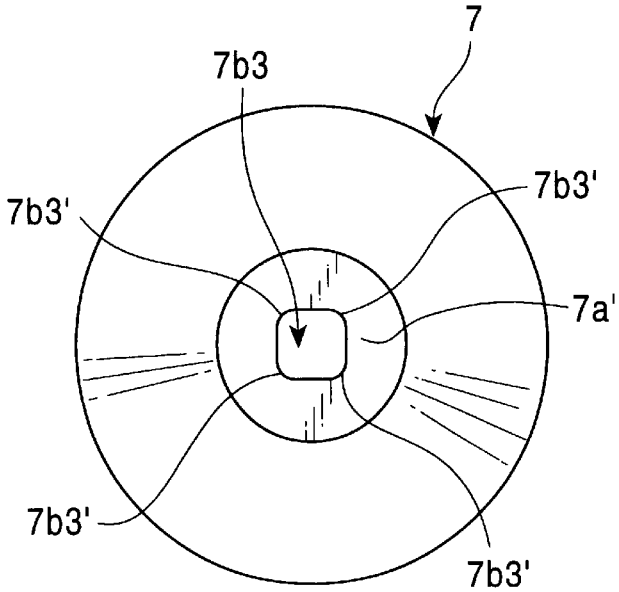
FIG. 6 is a top view of the first hollow guide shaft in FIG. 5 as seen from its top portion.

In the embodiment shown in FIGS. 5 and 6, the yarn passing hole 7*b* is formed into a generally square hole 7*b*3, wherein the reversed fibers v1, which are being whirled in the circumferential direction, are subjected to a higher resistance and thus whirled slower when passing through a corner portion 7*b*3' of the generally square hole 7*b*3. As described above, although the yarn passing hole 7*b* may be formed into the generally square hole 7*b*3 over its length, that is, the length of the first hollow guide shaft 7, if it is formed into the generally square hole 7*b*3 extending from the tip surface 7*a*' of the tip portion 7*a* over the average fiber length of the fibers v constituting the sliver V, at maximum, then the whirling speed of the reversed fibers v1, which are being whirled in the circumferential direction, can be varied sufficiently, as described above.

The yarn passing hole 7*b* formed in the first hollow guide shaft 7 is not limited to the laterally elongate hole 7*b*1, the elliptic hole 7*b*2, and the generally square hole 7*b*3, but it has only to appear non-circular as seen from the tip portion 7*a*.

Further, the above described embodiment shows the example where the hollow guide shaft member S comprises the front hollow guide shaft portion S1 composed of the first hollow guide shaft 7 and the second hollow guide shaft 8, the guide plate portion 9 composed of the plurality of guide plates 9*a*, 9*b* and 9*c*, and the rear hollow guide shaft portion S2. The hollow guide shaft member S, however, may comprise only the first hollow guide shaft 7.

Next, the configuration of a characteristic portion will be described in connection with another embodiment, with reference to FIGS. 7 to 11. The example in FIGS. 7 to 11 describes an example where the object of the present invention is achieved by forming the yarn passing hole 7*b* so as to have a circular (round) cross section over its length and modifying the outer peripheral shape of the tip portion 7*a* of the first hollow guide shaft 7.

The results of the studies conducted by the inventor indicate that when the reversed fibers v1 are whirled at a substantially constant speed in the circumferential direction of the tip portion 7*a* (the area in contact with the reversed fibers v1) of the first hollow guide shaft 7 due to the whirling current formed around the tip portion 7*a* of the first hollow guide shaft 7 by means of the air injected from the air injecting hole 1*a* in the nozzle block 1, the reversed fibers v1 are prevented from being disturbed to reduce the amount of hairiness in a spun-out yarn but that if the whirling force of the reversed fibers v1, which are being whirled in the circumferential direction, is restrained at the tip portion 7*a* of the first hollow guide shaft member 7 to partly vary the speed of the reversed fibers v1 in the circumferential direction, then the rear end portion v1" of the reversed fibers v1 becomes likely to leave the outer peripheral surface of the tip potion 7*a* of the first hollow guide shaft 7 to increase the amount of hairiness occurring in the spun-out yarn, while restraining tightening of the wound fibers against the spun yarn to provide a soft yarn. That is, the inventor has found that when the whirling speed of the reversed fibers v1 is positively varied in the circumferential direction, the amount of hairiness can be increased to manufacture a soft spun yarn.

Figure 7:
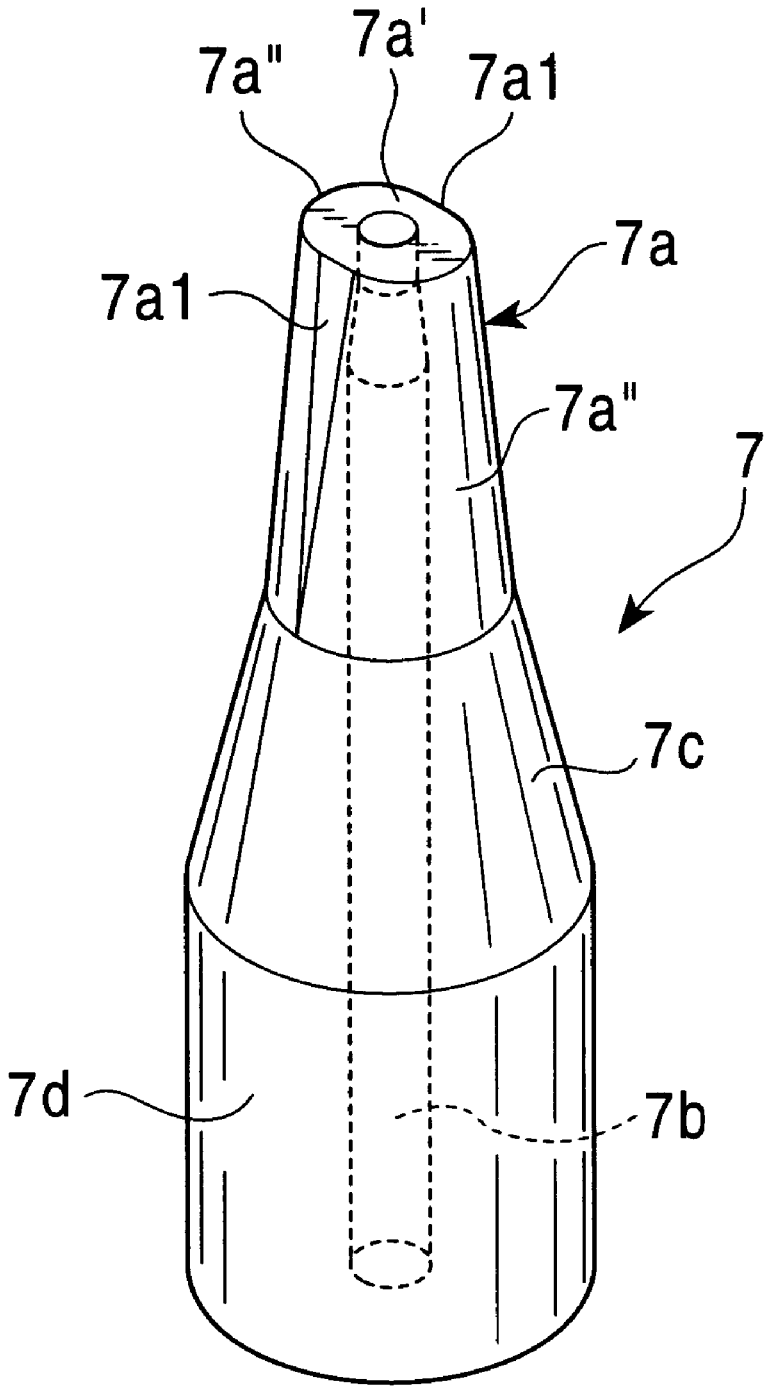
FIG. 7 is a perspective view of the first hollow guide shaft constituting the hollow guide shaft member of the spinning apparatus according to the present invention.

To vary the whirling speed of the reversed fibers v1 at the tip portion 7*a* of the first hollow guide shaft 7, the reversed fibers v1 being whirled in the circumferential direction, the embodiment shown in FIG. 7 forms the outer peripheral surface 7*a*" of the tapered tip portion 7*a* of the first hollow guide shaft 7 such that its cross section perpendicular to the axis of the first hollow guide shaft 7 is not circular. In the example shown in FIG. 7, a part of the outer peripheral surface 7*a*" of the tip portion 7*a* of the truncated cone-shaped first hollow guide shaft 7 is removed starting with its bottom toward a tip surface 7*a* so as to form a flat surface 7*a*1 extending from a tip surface 7*a*' in an axial direction over a predetermined length, so that its cross section perpendicular to the axis of the first hollow guide shaft 7 is not circular. Although the cross section perpendicular to the axis of the first hollow guide shaft 7 may be formed to have a non-circular shape over the length of the first hollow guide shaft 7, if it is formed into a non-circular shape extending from the tip surface 7*a*' of the tip portion 7*a* over the average fiber length of the fibers v constituting the sliver V, at maximum, then the whirling speed of the reversed fibers v1, which are being whirled in the circumferential direction, can be varied sufficiently, as described above. The tip portion 7*a* is an area on which the reversed fibers v1 having their tips located in the yarn passing hole 7*b* are wound, and a larger-diameter portion 7*d* is provided downstream of the tip portion 7*a* via a tapered portion 7*c*. The yarn passing hole 7*b* is formed so as to penetrate the tip portion 7*a*, the tapered portion 7*c*, and the larger-diameter portion 7*d*.

When the flat surface 7*a*1 is formed on the outer peripheral surface 7*a*" of the tip portion 7*a* of the truncated cone-shaped first hollow guide shaft 7, the reversed fibers v1 are braked in a transitional portion from a straight portion formed of the flat surface 7*a*1 to a curve portion in which the flat surface 7*a*1 is not formed, thus restraining the whirling force of the reversed fibers v1, which are being whirled in the circumferential direction, so that the whirling speed of the reversed fibers v1 can be partly varied.

Figure 8:
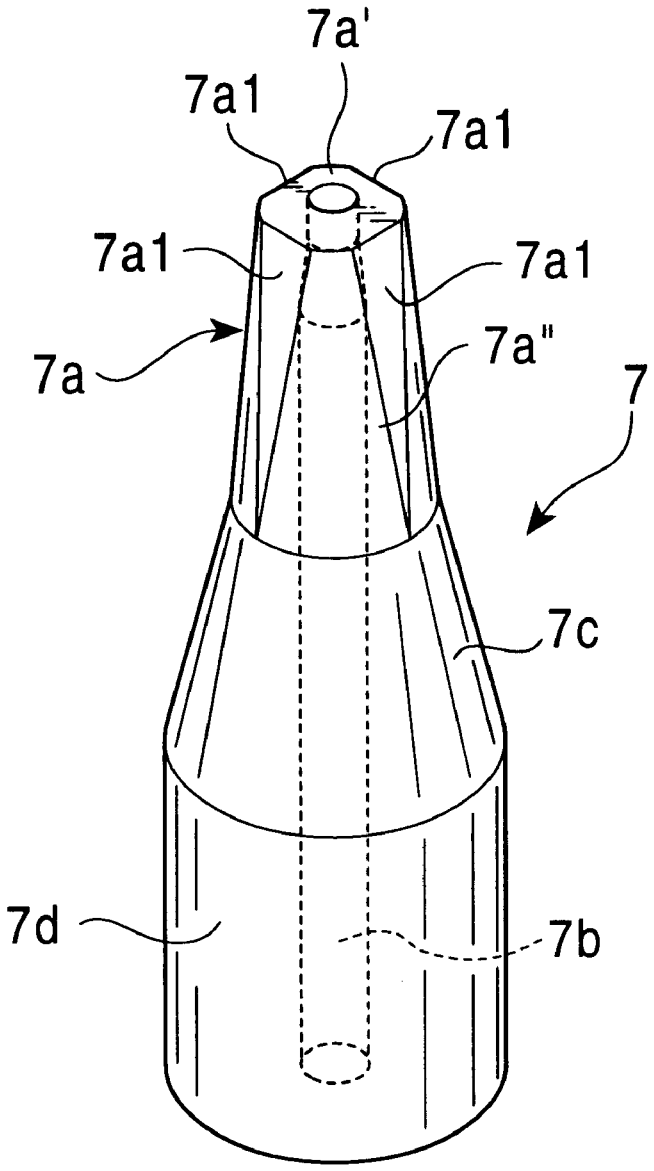
FIG. 8 is a perspective view of another embodiment of the first hollow guide shaft constituting the hollow guide shaft member of the spinning apparatus according to the present invention.

FIG. 7 shows an example where two of the above-mentioned flat surfaces 7*a*1 are formed so as to be mutually offset through 180 degrees, that is, to be opposite to each other, and FIG. 8 shows an example where four of the above-mentioned flat surfaces 7*a*1 are formed so as to be mutually offset through 90 degrees. The number of formed flat surfaces 7*a*1 need not be limited to two or four as in FIGS. 7 and 8, but any number, including an odd number such as one or three, of flat surfaces 7*a*1 may be formed at substantially equal intervals. With respect to the relationship between the number of flat surfaces 7*a*1 and uniformity, a value indicative of the degree of the variation of the yarn strength, the uniformity of the yarn strength is higher, that is, the variation of the yarn strength is smaller with two flat surfaces 7*a*1 than with one flat surface 7*a*1. Additionally, the uniformity of the yarn strength is higher with four (even number) flat surfaces 7*a*1 than with three (odd number) flat surfaces 7*a*1 irrespective of the direction in which the first hollow guide shaft 7 is set (whether the flat surfaces 7*a*1 or the curve portions are directed upward).

As described above, when the outer peripheral surface 7*a*' of the tapered tip portion 7*a* of the first hollow guide shaft 7 is formed such that its cross section perpendicular to the axis of the first hollow guide shaft 7 is not circular, the whirling force of the reversed fibers v1, which are being whirled in the circumferential direction, can be restrained to partly vary the speed of the reversed fibers v1, thus increasing the amount of hairiness occurring in the spun-out yarn to manufacture a soft spun yarn with much hairiness without reducing the strength of the generated spun yarn. For example, the use of the first hollow guide shaft 7 shown in FIG. 7 increases the amount of hairiness per unit length by a factor of about 3.

The above-mentioned non-circular shape may be configured by forming the outer peripheral shape of the tip portion 7*a* of the first hollow guide shaft 7 in a fashion having different curvatures in the circumferential direction as in an ellipse, for example.

Figure 9:
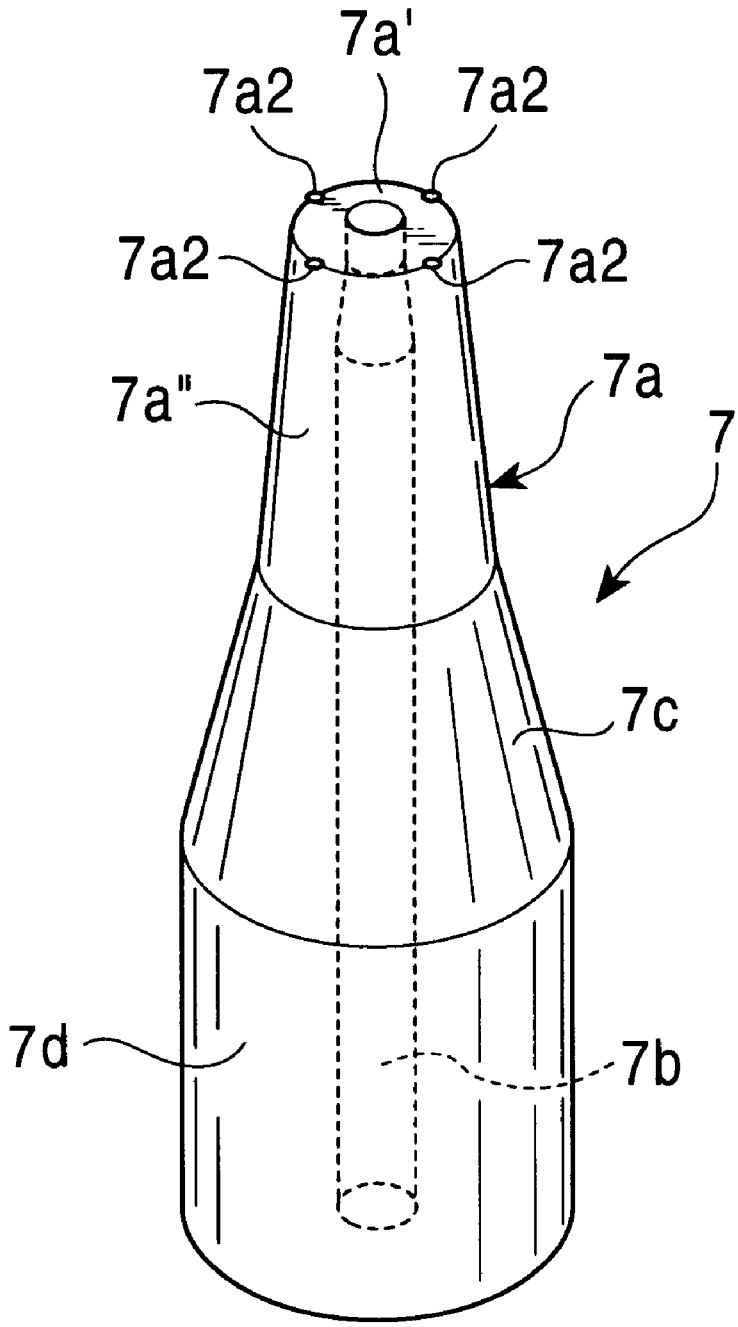
FIG. 9 is a perspective view of yet another embodiment of the first hollow guide shaft constituting the hollow guide shaft member of the spinning apparatus according to the present invention.

In the embodiment shown in FIG. 9, projecting portions 7*a*2 are formed on the outer peripheral surface 7*a*" or tip surface 7*a*' of the tip portion 7*a* of the truncated cone-shaped first hollow guide shaft 7. In the embodiment shown in FIG. 9, the projecting portions 7*a*2 are formed in the boundary between the outer peripheral surface 7*a*" and tip surface 7*a*' of the tip portion 7*a*, but they may be provided anywhere as long as the rear end portion v1" of the reversed fibers v1 is caught on the projecting portions 7*a*2 to reduce their whirling speed. With the projecting portions 7*a*2, if the reversed fibers v1 are caught on the projecting portions 7*a*2, the whirling force of the reversed fibers v1, which are being whirled in the circumferential direction, is restrained to reduce the whirling speed, whereas the latter is increased in the areas other then the projecting portions 7*a*2, thereby varying the whirling speed of the reversed fibers v1, which are being whirled in the circumferential direction. The projecting portions 7*a*2 are preferably formed in the outer peripheral portion of the tip surface 7*a*' (in the boundary between the outer peripheral surface 7*a*" and tip surface 7*a*' of the tip portion 7*a*).

Figure 10:
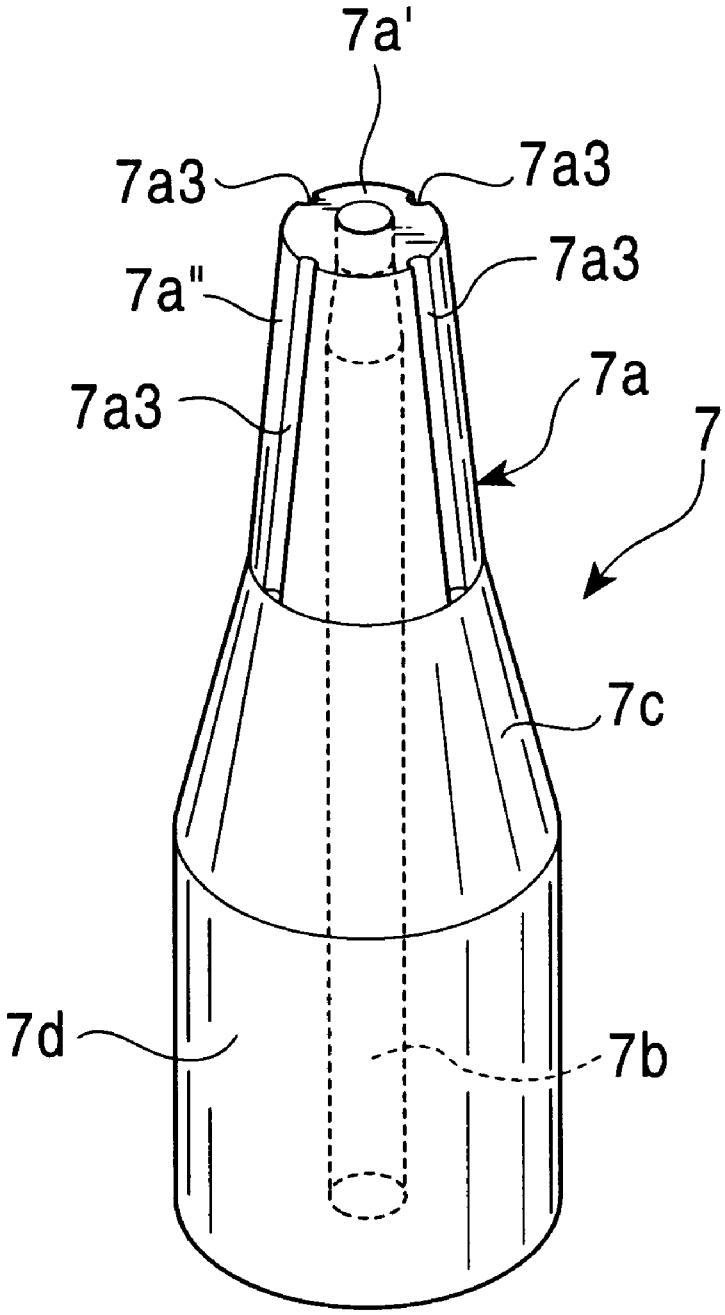
FIG. 10 is a perspective view of still another embodiment of the first hollow guide shaft constituting the hollow guide shaft member of the spinning apparatus according to the present invention.

In the example shown in FIG. 10, groove portions 7*a*3 extending to the tip surface 7*a*' are formed in the outer peripheral surface 7*a*" of the tip portion 7*a* of the truncated cone-shaped first hollow guide shaft 7, at appropriate intervals in the circumferential direction. With these groove portions 7*a*3 extending from the tip surface 7*a*' in the axial direction over a predetermined length, if the reversed fibers v1 slide in the groove portions 7*a*3, the whirling force of the reversed fibers v1, which are being whirled in the circumferential direction, is restrained to reduce the whirling speed, whereas the latter is increased if the reversed fibers v1 are out of the groove portions, thereby varying the whirling speed of the reversed fibers v1, which are being whirled in the circumferential direction.

Figure 11:
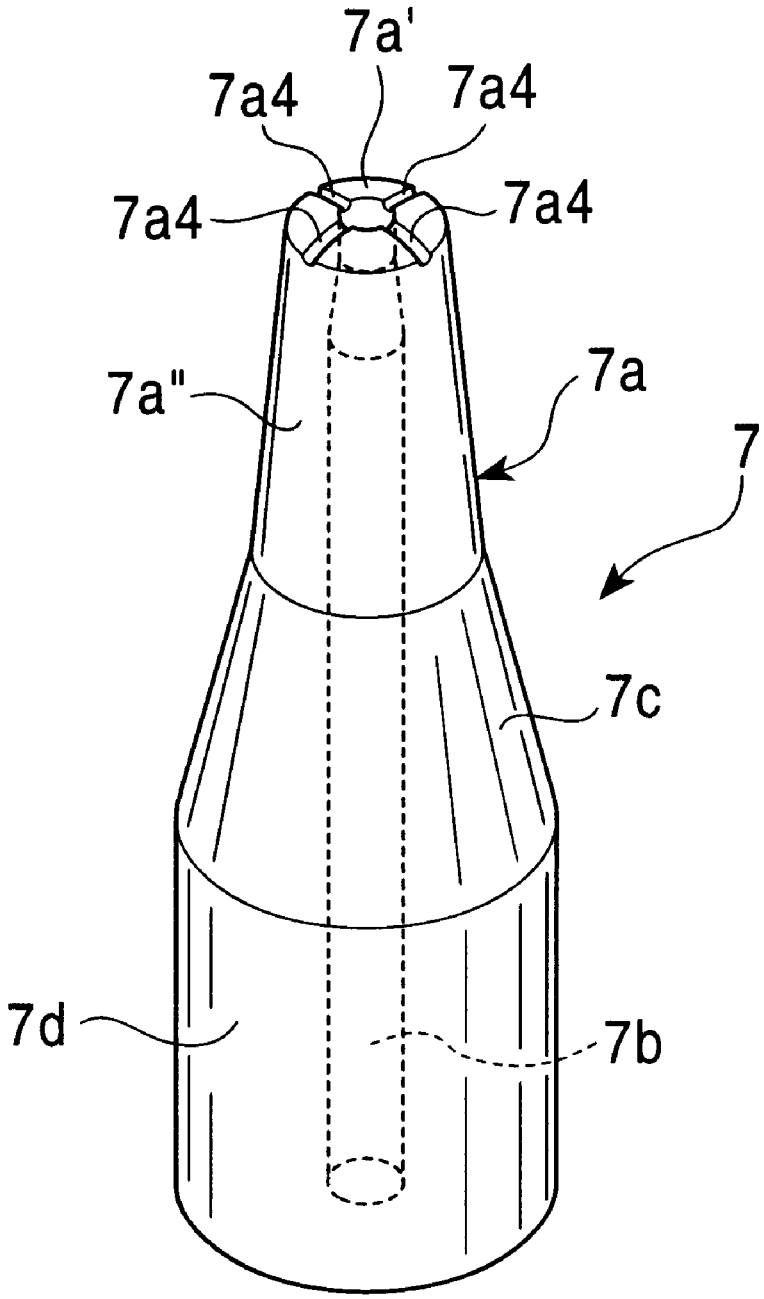
FIG. 11 is a perspective view of still another embodiment of the first hollow guide shaft constituting the hollow guide shaft member of the spinning apparatus according to the present invention.

In the embodiment shown in FIG. 11, four groove portions 7*a*4 are formed like a cross in the tip surface 7*a*' of the tip portion 7*a* of the truncated cone-shaped first hollow guide shaft 7. With these groove portions 7*a*4 formed in the tip surface 7*a*', if the reversed fibers v1 slide in the groove portions 7*a*4, the whirling force of the reversed fibers v1, which are being whirled in the circumferential direction, is restrained to reduce the whirling speed, whereas the latter is increased if the reversed fibers v1 are out of the groove portions 7*a*4, thereby varying the whirling speed of the reversed fibers v1, which are being whirled in the circumferential direction. An appropriate number, including an even or odd number, of groove portions 7*a*4 can be formed in the tip surface 7*a*'. However, to obtain a uniform yarn strength regardless of the set direction, at least four groove portions 7*a*4 are preferably formed.

The formation of the projecting portions 7*a*2 or the groove portions 7*a*3 or 7*a*4 can be combined with the formation of the outer peripheral surface 7*a*' of the tapered tip portion 7*a* of the first hollow guide shaft 7 such that its cross section perpendicular to the axis of the first hollow guide shaft 7 is not circular. Further, the formation of the outer peripheral surface 7*a*' of the tip portion 7*a* so as to have a non-circular cross section can be combined with the formation of the projecting portions 7*a*2 or the groove portions 7*a*3 or 7*a*4 on the outer peripheral surface 7*a*" or tip surface 7*a*' of the tip portion 7*a* of the first hollow guide shaft 7.

In each of the embodiments in FIGS. 7 to 11, the outer periphery of the tip surface 7*a*' is preferably not circular as seen from the inlet side of the first hollow guide shaft 7.

The above described embodiments show the examples where the flat surfaces 7*a*1, the projecting portions 7*a*2, or the groove portions 7*a*3 or 7*a*4 are independently and separately formed on the tip portion 7*a* of the first hollow guide shaft 7. However, the projecting portions 7*a*2 or the groove portions 7*a*3 or 7*a*4 can be formed in addition to the flat surfaces 7*a*1. Further, in order to similarly vary the whirling speed of the reversed fibers, the above described embodiments can be combined with the formation of the yarn passing hole 7*b* in the tip portion 7*a* so as not to circular (an ellipsis or the like).

The above described embodiments shows the example where the hollow guide shaft member S comprises the front hollow guide shaft portion S1 composed of the first hollow guide shaft 7 and the second hollow guide shaft 8, the guide plate portion 9 composed of the plurality of guide plates 9*a*, 9*b* and 9*c*, and the rear hollow guide shaft portion S2. The hollow guide shaft member S, however, may comprise only the first hollow guide shaft 7.

For the characteristic configurations of the present invention, the example where the cross section of the yarn passing hole 7*b* of the first hollow guide shaft 7 is improved has been explained with reference to FIGS. 1 to 6, and the example where the outer periphery of the tip portion 7*a* of the first hollow guide shaft 7 is improved has been explained with reference to FIGS. 7 to 11. However, the embodiments may not only be individually implemented but two or more of them may also be combined together.

According to the present invention, the yarn passing hole at the tip portion of the hollow guide shaft member is formed to have a non-circular cross section. This makes it possible to vary the whirling speed of the reversed fibers in the circumferential direction to manufacture a soft spun yarn with many hairinesses without reducing the yarn strength. Accordingly, when the spinning apparatus according to the present invention is used to weave spun yarns, a cloth product that feels soft can be manufactured.

Further, this configuration does not require a nozzle pressure (injection pressure) of the nozzle member to be changed, thereby making it possible to maintain an optimal flow rate for spinning. This serves to solve the problem that physical property values of yarns vary depending on the yarn number count or the like.

Further, the yarn passing hole at the tip portion of the hollow guide shaft member has a laterally elongate or an elliptic cross section. This makes it possible to smoothly vary the whirling speed of the reversed fibers in the circumferential direction to prevent yarn breakage or the like.

Furthermore, the maximum length of the yarn passing hole formed into a noncircular shape which length starts from the yarn passing hole inlet located in the tip surface of the hollow guide shaft member equals the average fiber length of fibers constituting a fiber bundle. Consequently, only a portion of the yarn passing hole which is involved in the whirling of the reversed fibers (the portion which affects the whirling speed of the reversed fibers) has a non-circular cross section, while a portion that is not involved in the whirling of the reversed fibers has a circular cross section. Therefore, a smooth air current can be maintained through the yarn passing hole in the hollow guide shaft member, thus preventing degradation of the quality of the generated spun yarn.

According to the present invention, the yarn passing hole at the tip portion of the hollow guide shaft member is formed to have a non-circular cross section. This makes it possible to vary the whirling speed of the reversed fibers in the circumferential direction to manufacture a soft spun yarn with much hairiness without reducing the yarn strength. Accordingly, when the spinning apparatus according to the present invention is used to weave spun yarns, a cloth product that feels soft can be manufactured.

Further, the flat surfaces or the projecting or groove portions as the restraining section are formed on the outer peripheral surface of the tip portion of the hollow guide shaft member. This makes it possible to effectively vary the whirling speed of the reversed fibers in the circumferential direction.

According to the present invention, the area at the tip portion of the hollow guide shaft member which area contacts with the reversed fibers is formed such that its cross section perpendicular to the axis of the hollow guide shaft member is not circular. This makes it possible to positively vary the whirling speed of the reversed fibers in the circumferential direction to thereby manufacture a soft spun yarn with many hairinesses without reducing the yarn strength. Consequently, a cloth product woven of such spun yarns has a softer feel. Moreover, since the wound fibers are restrained from being tightened against the spun yarn, the rotation torque of the yarn decreases, thus allowing the yarn to be more appropriately released and colored during subsequent processes.

What is claimed is:

1. A spinning apparatus comprising a nozzle member for generating a whirling current and a non-rotary hollow guide shaft member having a yarn passing hole operative to execute spinning while causing the whirling current generated by the nozzle member to act on a tip portion of the hollow guide shaft member, the hollow guide shaft member by being fixedly installed within the spinning apparatus and being characterized in that the yarn passing hole at the tip portion thereof is formed to have a non-circular cross section.

2. A spinning apparatus according to claim 1, characterized in that the yarn passing hole at the tip portion of the hollow guide shaft member has a laterally elongate or an elliptic cross section.

3. A spinning apparatus according to claim 1 or claim 2, characterized in that a maximum length of the yarn passing hole formed into a non-circular shape which length starts from the a yarn passing hole inlet located in a tip surface of the hollow guide shaft member equals an average fiber length of fibers constituting a fiber bundle.

4. A spinning apparatus comprising a nozzle member for generating a whirling current and a non-rotary hollow guide shaft member having a yarn passing hole so as operative to execute spinning while whirling reversed fibers at a tip portion of the hollow guide shaft member by means of the whirling current generated by the nozzle member, the hollow guide shaft member being characterized by means for fixed installation within the spinning apparatus and in that a restraining section for partly varying a whirling speed of the reversed fibers in a circumferential direction is provided on an outer peripheral surface of the tip portion of the hollow guide shaft member, which surface is contacted by the reversed fibers.

5. A spinning apparatus according to claim 4, characterized in that said restraining section further comprises flat surfaces formed on the outer peripheral surface of the tip portion of the hollow guide shaft member.

6. A spinning apparatus according to claim 5, characterized in that the flat surfaces are formed at generally equal intervals in a circumferential direction.

7. A spinning apparatus according to claim 4, characterized in that said restraining section further comprises projecting portions or groove portions formed on the outer peripheral surface of the tip portion of the hollow guide shaft member.

8. A spinning apparatus comprising a nozzle member for generating a whirling current and a non-rotary hollow guide shaft member having a yarn passing hole operative to execute spinning while whirling reversed fibers at a tip portion of the hollow guide shaft member by means of the whirling current generated by the nozzle member, the hollow guide shaft member being characterized by means for fixed installation within the spinning apparatus and in that an area at the tip portion of the hollow guide shaft member which outer peripheral surface shape of area contacts with the reversed fibers and is formed such that a cross section thereof, which is perpendicular to a central axis of the hollow guide shaft member, is not circular.

9. A spinning method for executing spinning while whirling reversed fibers at a tip portion of a non-rotary hollow guide shaft member by means of a whirling current acting on the tip portion of the hollow guide shaft member, the method being characterized by the steps of: fixing a hollow guide shaft member with respect to a nozzle for generating a whirling current, and positively varying a whirling speed of the reversed fibers at the tip portion of the hollow guide shaft member in a circumferential direction.

10. A spinning method according to claim 9, characterized by the further step of varying the whirling speed by partly restraining whirling of the reversed fibers at the tip portion of the hollow guide shaft member in the circumferential direction.

11. A hollow guide shaft member for spinning having a yarn passing hole for allowing a spun yarn generated from a fiber bundle to pass therethrough, the hollow guide shaft member executing spinning while generating a whirling current externally of a tip portion during a non-rotating state to thereby whirl reversed fibers at the tip portion, the hollow guide shaft member being characterized by means for fixedly installing such member in a spinning apparatus and in that the yarn passing hole at the tip portion has a non-circular cross section.

12. A hollow guide shaft member for spinning having a yarn passing hole for allowing a spun yarn generated from a fiber bundle to pass therethrough, the hollow guide shaft member executing spinning while generating a whirling current externally of a tip portion to thereby whirl reversed fibers at the tip portion, the hollow guide shaft member being characterized by means for fixedly installing such member in a spinning apparatus and in that a restraining section for partly varying a whirling speed of the reversed fibers in a circumferential direction is provided on an outer peripheral surface of the tip portion of the hollow guide shaft member which surface contacts with the reversed fibers.

13. A hollow guide shaft member for spinning according to claim 12, characterized in that flat surfaces as the restraining section are formed on the outer peripheral surface of the tip portion.

14. A hollow guide shaft member for spinning according to claim 13, characterized in that the flat surfaces as the restraining section are formed at substantially equal intervals in the circumferential direction.

15. A hollow guide shaft member for spinning according to claim 12, characterized in that projecting portions or groove portions as the restraining section are formed on the outer peripheral surface of the tip portion.

16. A hollow guide shaft member for spinning having a yarn passing hole for allowing a spun yarn generated from a fiber bundle to pass therethrough, the hollow guide shaft member executing spinning while generating a whirling current externally of a tip portion during a non-rotating state to thereby whirl reversed fibers at the tip portion, the hollow guide shaft member being characterized by means for fixing the member in a spinning apparatus with respect to a nozzle for generating a whirling current in that an outer periphery of the tip portion is formed such that a cross section thereof which is perpendicular to a longitudinal axis of the hollow guide shaft member is not circular.

* * * * *